US009847612B2

(12) United States Patent
Okamoto et al.

(10) Patent No.: US 9,847,612 B2
(45) Date of Patent: Dec. 19, 2017

(54) CONNECTOR

(71) Applicant: Yazaki Corporation, Tokyo (JP)

(72) Inventors: Kenichi Okamoto, Kakegawa-shi (JP); Toshiyuki Nagasawa, Kakegawa-shi (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/969,499

(22) Filed: Dec. 15, 2015

(65) Prior Publication Data

US 2016/0099529 A1 Apr. 7, 2016

Related U.S. Application Data

(63) Continuation of application No. PCT/JP2014/068455, filed on Jul. 10, 2014.

(30) Foreign Application Priority Data

Jul. 11, 2013 (JP) ..... 2013-145235

(51) Int. Cl.
*H01R 13/74* (2006.01)
*H01R 13/512* (2006.01)
(Continued)

(52) U.S. Cl.
CPC ..... *H01R 24/40* (2013.01); *H01R 13/512* (2013.01); *H01R 13/748* (2013.01); *H01R 2103/00* (2013.01); *H01R 2107/00* (2013.01)

(58) Field of Classification Search
CPC .. H01R 24/52; H01R 13/512; H01R 13/6592; H01R 13/6593; H01R 13/748
(Continued)

(56) References Cited

U.S. PATENT DOCUMENTS 5,702,266 A 12/1997 Jones
6,083,031 A 7/2000 Kuo
(Continued)

FOREIGN PATENT DOCUMENTS

CN 102222841 A 10/2011
JP 60-21183 U 2/1985
(Continued)

OTHER PUBLICATIONS

International Search Report dated Aug. 26, 2014, issued for PCT/JP2014/068455.
(Continued)

*Primary Examiner* — Edwin A. Leon
*Assistant Examiner* — Paul Baillargeon
(74) *Attorney, Agent, or Firm* — Locke Lord LLP; Howard M. Gitten

(57) ABSTRACT

A connector that prevents damage to an electric circuit provided inside a connecting object is provided. Two shield cables constituting a wire harness, a cable-side connector accommodating a distal end of the shield cable, and a device-side connector secured to a unit case are included. The cable-side connector includes a conductive shield shell including a shell body and a shell cap member, and a female housing that is made of an insulating resin and accommodated in the shield shell to allow the shield cable to be inserted therein. The shell securing portion for securing together the shell body and the shell cap member is provided in a position to oppose in the fastening direction of the bolt the device-side securing portion that secures the device-side connector to the unit case.

4 Claims, 4 Drawing Sheets

(51) Int. Cl.
*H01R 24/40* (2011.01)
*H01R 107/00* (2006.01)
*H01R 103/00* (2006.01)

(58) Field of Classification Search
USPC ... 439/95, 97, 101, 453, 454, 460, 461, 462, 439/465, 564, 573, 578, 607.55, 701
See application file for complete search history.

(56) References Cited

U.S. PATENT DOCUMENTS

| | | | | |
|---|---|---|---|---|
| 6,217,360 | B1 | 4/2001 | Parent | |
| 7,811,132 | B2 * | 10/2010 | Carpenter ..... | H01R 13/648 439/607.41 |
| 2007/0087621 | A1 | 4/2007 | Fukushima et al. | |
| 2014/0127939 | A1 | 5/2014 | Ishibashi et al. | |

FOREIGN PATENT DOCUMENTS

| | | | |
|---|---|---|---|
| JP | 2000-133345 | A | 5/2000 |
| JP | 2007-115428 | A | 5/2007 |
| JP | 2014-093289 | A | 5/2014 |

OTHER PUBLICATIONS

Notification of First Office Action issued by the State Intellectual Property Office of the People's Republic of China, dated Dec. 28, 2016, in corresponding Chinese Patent Application No. 201480036304.1.

* cited by examiner

CONNECTOR

TECHNICAL FIELD

The present invention relates to a connector including an object-side connector provided on a connecting object and a cable-side connector provided on an end of a cable.

BACKGROUND ART

Conventionally, to supply power to an object to be connected, such as an electronic device, a connector provided on an end of a cable for supplying power and a connector provided on an end of the object to which power is to be supplied are fitted together and coupled. For such coupling, various connectors are proposed (for example, see Patent Literature 1).

A connector disclosed in Patent Literature 1 includes a cable, a housing that holds an end of the cable, and an outer case that holds the cable and the housing. The outer case includes a shield shell and a shell holder that supports the cable and the connector from the opposite side of the shield shell. The cable and the housing are inserted in the shield shell, and then the shield shell and the shell holder are screwed and secured together using a securing tool to hold the cable and the housing at a securing portion at approximately the middle in the width direction of the shield shell and the shell holder.

CITATION LIST

Patent Literature

Patent Literature 1: JP 2007-115428 A

SUMMARY OF INVENTION

Technical Problem

However, in a connector disclosed in Patent Literature 1, an object-side connector coupled to a cable-side connector might be removed from the object. For example, when an object-side connector is suddenly decoupled from an electric circuit inside the object while power is supplied, a spark or a shorting might occur, which disadvantageously may cause damage to the electric circuit.

In view of such problem, an object of the present invention is to provide a connector that can prevent damage to an electric circuit provided inside a connecting object.

Solution to Problem

To solve the aforementioned problem, a connector according to the present invention includes a cable-side connector that supports a cable and a terminal part secured to a distal end of the cable, and an object-side connector provided on a connecting object and coupled to the cable-side connector. The object-side connector includes an object-side securing portion which is secured to the connecting object. The object-side securing portion is secured to the connecting object with a detachable fastening member. The cable-side connector includes an opposing portion that opposes the object-side securing portion in a fastening direction of the fastening member.

According to the present invention, the object-side securing portion for securing the object-side connector to the connecting object and the opposing portion provided on the cable-side connector oppose each other in the fastening direction of the fastening member, so that the object-side securing portion cannot be removed when the cable-side connector and the object-side connector are coupled because a tool for removing the fastening member interferes with the opposing portion. By disallowing removal of the object-side connector from the connecting object when the cable-side connector and the object-side connector are coupled, damage to an electric circuit provided inside the connecting object can be prevented.

Preferably, according to the embodiment, the cable-side connector further includes a housing that supports the cable and the terminal part and a supporting member that supports the cable and the housing, the supporting member includes a first supporting member and a second supporting member and supports the cable and the housing between the first supporting member and the second supporting member, and the opposing portion includes a first opposing portion integrally provided on the first supporting member, a second opposing portion integrally provided on the second supporting member, and a securing member that secures together the first opposing portion and the second opposing portion to secure together the first supporting member and the second supporting member.

In such a configuration in which the opposing portion is positioned to oppose the object-side securing portion in the connecting direction, the first opposing portion integrated with the first supporting part, and the second opposing portion integrated with the second supporting part are included, the opposing portion has a function of securing the first supporting part and the second supporting part as well as a function of disallowing removal of the object-side securing portion when the cable-side connector and the object-side connector are coupled, so that the structure can be made simple without providing any additional member.

Preferably, according to the present invention, the cable-side connector further includes a cable-side securing portion secured to the connecting object with another detachable fastening member, and the cable-side securing portion does not overlap with the opposing portion when viewed in a fastening direction of the other fastening member.

In such a configuration in which the cable-side connector includes the cable-side securing portion that is secured to the connecting object with the other detachable fastening member, the cable-side connector can surely be secured to the connecting object, thereby preventing decoupling of the cable-side connector and the object-side connector by vibration or the like. Furthermore, since the cable-side securing portion is provided so as not to overlap with the opposing portion when viewed in the fastening direction of the other fastening member, unfastening of the cable-side securing portion from the connecting object can easily be recognized when removing the cable-side connector, which thereby prevents accidental removal of the object-side securing portion. That is, since the cable-side securing portion is not overlapping with the opposing portion in the fastening direction of the other fastening member but the object-side securing portion is overlapping with the opposing portion in the fastening direction of the fastening member, only the other fastening member securing the cable-side securing portion can be removed. Thus the sequential procedure of removing the connector can be determined.

Preferably, according to the present invention, the cable-side connector further includes a housing that supports the cable and the terminal part, a supporting member that supports the cable and the housing, and a cable-side securing portion that is secured to the connecting object with the other detachable fastening member, the supporting member includes a first supporting member and a second supporting member and supports the cable and the housing between the first supporting member and the second supporting member, the opposing portion is integrally provided on the first supporting member, and the cable-side securing portion is integrally provided on the first supporting member and does not overlap with the opposing portion when viewed in a fastening direction of the other fastening member.

In such a configuration, the opposing portion and the cable-side securing portion are integrally provided on the first supporting member. Thus, even when the second supporting member is removed, the first supporting member is secured to the connecting object to keep the cable-side connector coupled to the object-side connector and to disallow removal of the object-side securing portion by causing interference between a tool for removing the fastening member and the opposing portion.

Preferably, according to the present invention, the electric-side connector includes a supporting member securing portion integrally provided on the second supporting member, and the first supporting member and the second supporting member are secured together by a securing member that secures the opposing portion and the supporting member securing portion.

In such a configuration, the opposing portion is integrally provided on the first supporting member, the supporting member securing portion integrated with the second supporting member is provided on the second supporting member, and the first supporting member and the second supporting member are secured together with the securing member that secures together the opposing portion and the supporting member securing portion. Thus, the opposing portion has a function of securing together the first supporting part and the second supporting part as well as a function of disallowing removal of the object-side securing portion when the cable-side connector and the object-side connector are coupled, so that the structure can be made simple without providing any additional member.

Advantageous Effects of Invention

As described above, the connector according to the present invention is configured to disallow unfastening of the object-side securing portion when the cable-side connector and the object-side connector are coupled by causing interference of a tool with the opposing portion, thereby disallowing removal of the object-side connector from the connecting object. The damage to the electric circuit provided inside the connecting object can thus be prevented.

DESCRIPTION OF EMBODIMENTS

Figure 1:
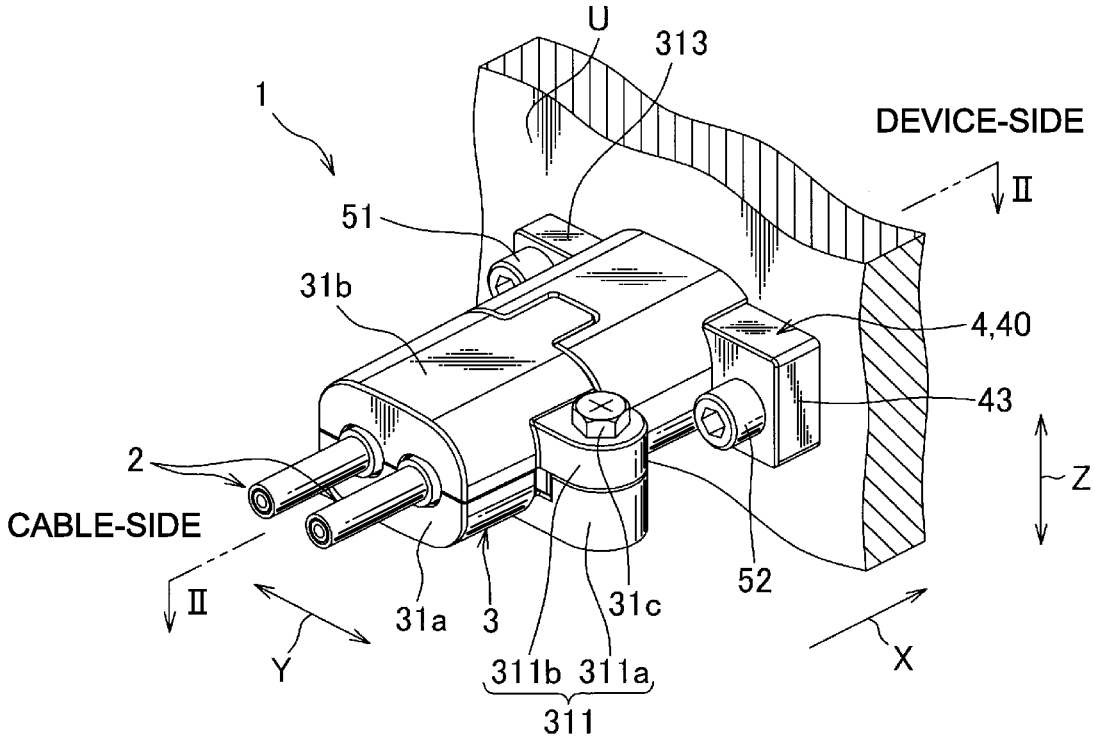
FIG. 1 is a perspective view illustrating a connector according to one embodiment of the present invention.
Figure 2:
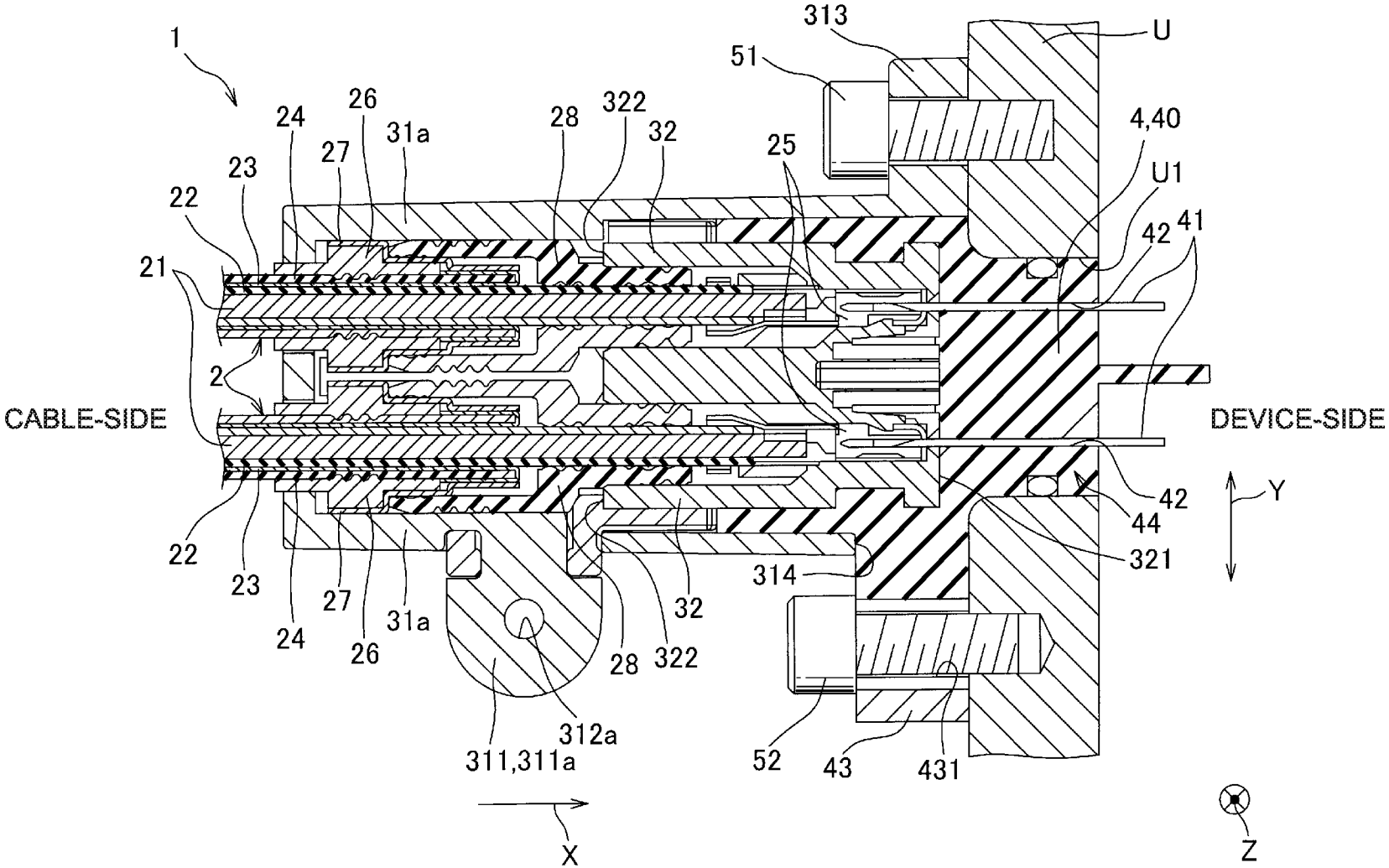
FIG. 2 is a sectional view of the connector taken along the line II-II in FIG. 1.

An embodiment of the present invention will be described below referring to the drawings. As illustrated in FIGS. 1 and 2, a shield connector 1 according to the embodiment includes two shield cables 2 constituting a wire harness, a cable-side connector 3, which is a female-side connector configured to accommodate distal ends of the shield cables 2, a device-side connector 4, which is a male-side connector configured to accommodate a male terminal 41 connected to an electric device (not shown), and bolts 51 and 52, which are detachable fastening members for securing the cable-side connector 3 and the device-side connector 4 to a unit case U. By securing the device-side connector 4 to the unit case U accommodating the electric device (not shown) and coupling the device-side connector 4 to the cable-side connector 3, the electric circuit inside the electric device and the wire harness are electrically connected. The shield connector 1 according to the embodiment is used to electrically connect electric devices equipped in a vehicle, such as a battery, a motor, and an inverter. In the embodiment, the direction in which the cable-side connector 3 and the device-side connector 4 are coupled is referred to as connecting direction X, indicated by an arrow X. The width direction of the shield connector 1 perpendicular to the connecting direction X is indicated by an arrow Y, and the height direction is indicated by an arrow Z. The device side and the cable side along the connecting direction X are as illustrated in FIGS. 1 and 2. The upper side and the lower side along the direction indicated by the arrow Z should be construed with reference to FIG. 1. In the embodiment, the fastening directions of the bolts 51 and 52 are the same as the connecting direction X. The shield connector 1, the shield cable 2, the electric device (not shown), the device-side connector 4, the bolt 51, and the bolt 52 respectively correspond to "connector", "cable", "connecting object", "object-side connector", "other fastening member", and "fastening member".

The two shield cable 2 are provided in parallel to each other and arrayed along the Y direction. Each of the shield cables 2 is a coaxial cable configured with a conductor 21 formed of, for example, a twisted wire composed of twisted element wires, an internal insulating sheath 22 composed of, for example, an insulating synthetic resin to cover the periphery of the conductor 21, a shield 23 composed of, for example, a braided conductor provided to cover the periphery of the internal insulating sheath 22, and an external insulating sheath 24 composed of, for example, an insulating synthetic resin to cover the periphery of the shield 23. On the portion of the shield cable 2 that is accommodated in the cable-side connector 3, a female terminal 25 connected to a distal end of the conductor 21, a packing 26 provided on the external of the external insulating sheath 24 to prevent intrusion of water into the shield shell 31, which will be described later, a tubular shield pipe 27 configured to secure the shield 23 and the packing 26 by swaging, and a sealing member 28 formed of an elastic material such as rubber having a sleeve shape configured to provide sealing between the shield cable 2 and a female housing 32, which will be described later, are provided. The shield pipe 27 is electrically connected to the shield 23 to function as a connecting member.

The cable-side connector 3 includes a conductive shield shell 31 including a shell body 31*a* and a shell cap member 31*b*, a female housing 32 made of an insulating resin accommodated in the shield shell 31 with the shield cable 2 being penetratingly disposed in the female housing 32, and a shell securing portion 311 that secures together the shell body 31*a* and the shell cap member 31*b*. The shield shell 31 serves as the outer case of both the cable-side connector 3 and the device-side connector 4. The shell body 31*a* and the shell cap member 31*b* overlap in the Z direction to constitute a single shield shell. The shield shell 31, the female housing 32, the shell securing portion 311, the shell body 31*a*, and the shell cap member 31*b* respectively correspond to "supporting member", "housing", "opposing portion", "first supporting member", and "second supporting member" in the claims.

Figure 3:
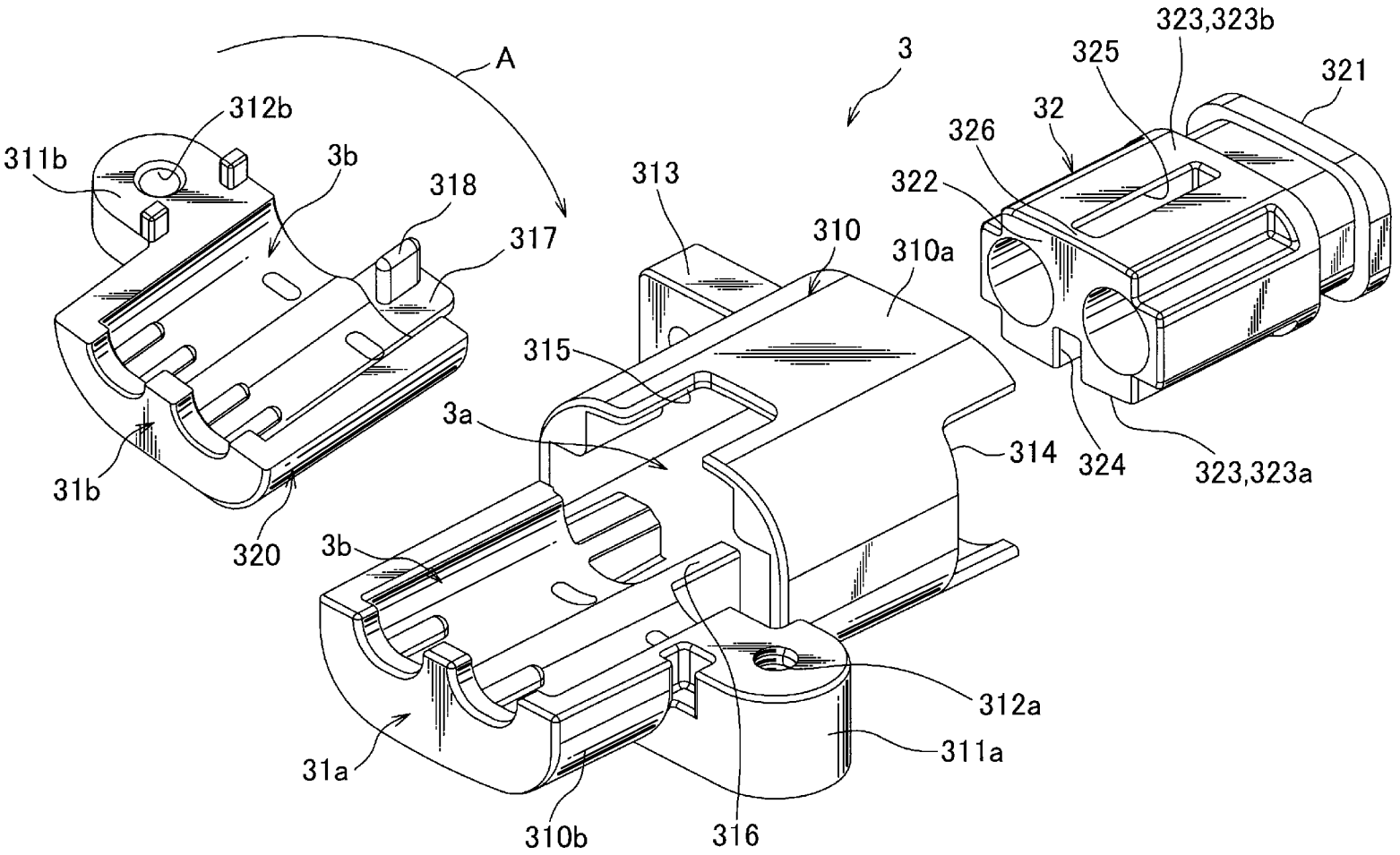
FIG. 3 is a perspective view illustrating components of a cable-side connector of the connector.

As illustrated in FIGS. 2 and 3, the shield shell 31 includes a first accommodating portion 3*a* that accommodates the female housing 32 and a second accommodating portion 3*b* that accommodates the shield cable 2 and the shield pipe 27. A shell securing portion 311 is provided in a first side in the Y direction (the lower right side in FIG. 1) on the external of the first accommodating portion 3*a* and the second accommodating portion 3*b*. The shell securing portion 311 is positioned to oppose a device-side securing portion 43, which will be described later, in the fastening direction of the bolt 52 for securing the device-side securing portion 43. The shell securing portion 311 includes a body-side securing portion 311*a* (corresponding to the "first opposing portion" in the claims) integrally provided on the shell body 31*a*, a cap-side securing portion 311*b* (corresponding to the "second opposing portion" in the claims) integrally provided on the shell cap member 31*b*, and a bolt 31*c*, which is a securing member for securing together the shell body 31*a* and the shell cap member 31*b*. The body-side securing portion 311*a* and the cap-side securing portion 311*b* are respectively provided with insertion holes 312*a* and 312*b* in each of which the bolt 31*c* can be inserted. The insertion hole 312*a* provided in the body-side securing portion 311*a* has a tapped thread. The insertion hole 312*b* provided in the cap-side securing portion 311*b* penetrates the cap-side securing portion 311*b* and allows the bolt 31*c* to be inserted therein in the direction indicated by the arrow Z in the figure.

As illustrated in FIGS. 2 and 3, the shell body 31*a* includes a main body 310, a cable-side securing portion 313 used for securing the shell body 31*a* to the unit case U with the detachable bolt 51, a cutout 314 having a shape tracing the profile of a device-side securing portion 43, which will be described later, a receiver groove 315 for receiving a protruding portion 317 of the shell cap member 31*b*, which will be described later, and a rib 316 provided upright on the inner circumferential surface of the shell body 31*a* to protrude toward the shell cap member 31*b* and extend in the connecting direction X inside the first accommodating portion 3*a*.

The main body 310 includes a cylindrical portion 310*a* having an approximately cylindrical shape with the inner profile tracing the outer shape of the female housing 32, and a half-cylindrical portion 310*b* continuing from the lower part of the cylindrical portion 310*a* to extend in the connecting direction X toward the cable side. The cable-side securing portion 313 protrudes along the unit case U in the Y direction from the side face in the second side in the Y direction (upper left side in FIG. 1) on the end portion of the cylindrical portion 310*a* in the device side in the connecting direction X. That is, the cable-side securing portion 313 is provided so as not to overlap with the shell securing portion 311 when viewed in the fastening direction of the bolt 51.

The cutout 314 is provided in a side face in the first side in the Y direction on the end portion of the cylindrical portion 310*a* in the device side in the connecting direction X. The receiver groove 315 is provided in a portion at the end of the cylindrical portion 310*a* in the cable side in the connecting direction X where the shell cap member 31*b* comes. The rib 316 is provided upright on the inner face of the cylindrical portion 310*a* in the lower side in the Z direction. The body-side securing portion 311*a* is integrally provided on the shell body 31*a* to protrude in the Y direction from a side face of the half-cylindrical portion 310*b* in the first side in the Y direction.

As illustrated in FIG. 3, the shell cap member 31*b* further includes a cap main body 320 having an approximately half cylindrical shape placed on the half-cylindrical portion 310*b* of the shell body 31*a*, a protruding portion 317 continuing from an approximate center along the Y direction of the end portion of the cap main body 320 in the device side along the connecting direction X to extend in the connecting direction X toward the device side, and an engagement portion 318 provided on the protruding portion 317 to extend in the Z direction from the first accommodating portion 3*a* toward the shell body 31*a*. The cap main body 320 is shaped so as to form a face continuing from the face of the cylindrical portion 310*a* in the upper Z direction side when the cap main body 320 is placed on and attached to the half-cylindrical portion 310*b* of the shell body 31*a* from the upper Z direction. When the shell cap member 31*b* is attached to the shell body 31*a*, the engagement portion 318 is inserted in a recess 325, which will be described later, of the female housing 32 to make contact with a wall 326 from the device side. The cap-side securing portion 311*b* is integrally provided on the shell cap member 31*b* so as to protrude in the Y direction from the side face of the cap main body 320 in the first side in the Y direction when the shell cap member 31*b* is placed on the shell body 31*a*.

As illustrated in FIGS. 2 and 3, the female housing 32 includes a coupling portion 321 having an approximately rectangular solid shape of which external profile traces the profile of the first accommodating portion 3*a* of the shield shell 31 and provided in the device side in the connecting direction X to receive and make connection with the male terminal 41 of the device-side connector 4, a cable lead-out portion 322 through which the shield cable 2 is led out from the cable side in the connecting direction X, and an outer peripheral portion 323 extending in the connecting direction X from the coupling portion 321 to the cable lead-out portion 322 and having four faces.

Among four faces of the outer peripheral portion 323, an outer peripheral portion 323*a* makes contact with the face of the shell body 31*a* on which the rib 316 is provided. The outer peripheral portion 323*a* is provided with a groove 324 extending along the connecting direction X to the end of the cable side to receive the rib 316 of the shell body 31*a* to the end of the cable side. An outer peripheral portion 323*b* provided to the outer peripheral portion 323 in the opposite side of the outer peripheral portion 323*a*. The shield cable 2 inserted in the female housing 32 is disposed between the outer peripheral portions 323*a* and 323*b*. The outer peripheral portion 323*b* is provided with a recess 325 and a wall 326. The recess 325 is provided in the same location in the Y direction as the groove 324 and extends along the connecting direction X. The engagement portion 318 of the shell cap member 31*b* can be inserted in the recess 325. The wall 326 is provided to plug the end of the recess 325 in the cable side.

The device-side connector 4 includes a male housing 40 formed of an insulating resin including a device-side main body 44 and a device-side securing portion 43 in an integrated manner. The device-side main body 44 is provided with an insertion portion 42 in which the male terminal 41 is inserted. The device-side securing portion 43 (corresponding to the "object-side securing portion" in the claims) is secured to the unit case U. The Dimension and shape of the male housing 40 in the cable side in the connecting direction X trace the inner form of the cylindrical portion 310*a* of the shield shell 31. The Dimension and shape of the male housing 40 in the device side X in the connecting direction X trace the shape of an opening U1, which will be described later, of the unit case U.

Figure 4:
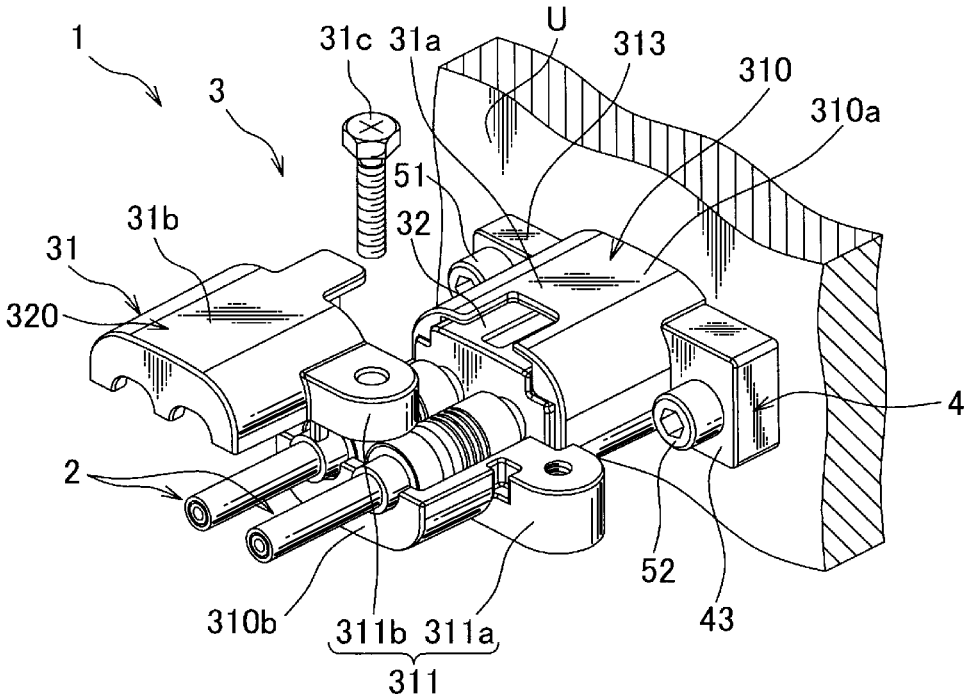
FIG. 4 is an exploded perspective view of the connector.
Figure 5:
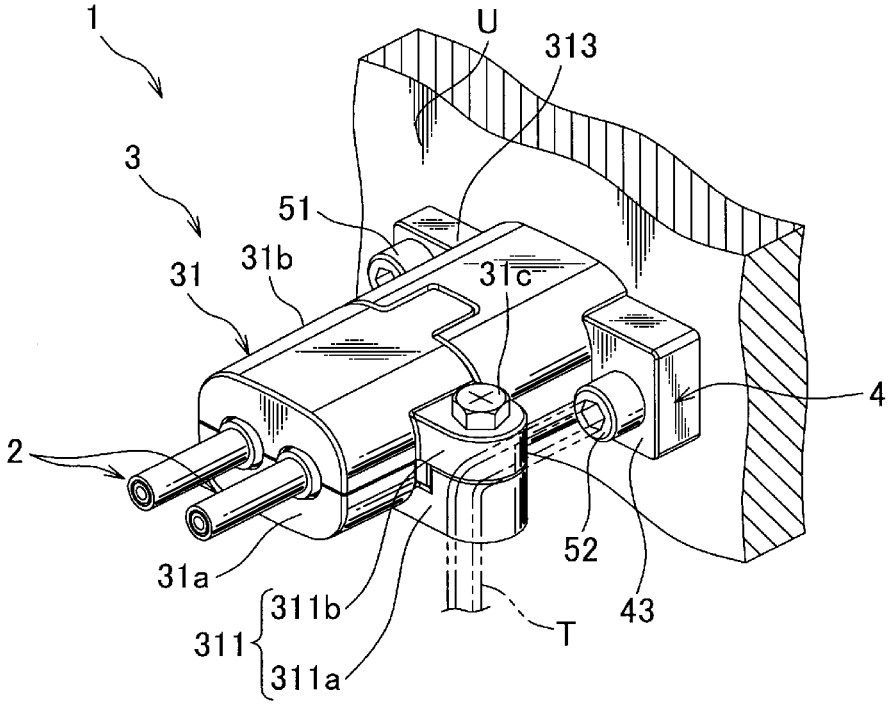
FIG. 5 is a perspective view illustrating the connector when being removed.

As illustrated in FIGS. 1, 2, and 4, the device-side securing portion 43 is provided to protrude along the unit case U in the Y direction from the side face of the device-side main body 44 in the first side in the Y direction. The shield connector 1 includes the body-side securing portion 311*a* and the cap-side securing portion 311*b* respectively provided on the shell body 31*a* and the shell cap member 31*b* in an integrated manner and a device-side securing hole 431 in which the bolt 52 for securing the device-side connector 4 to the unit case U is inserted from the cable side in the connecting direction X. The device-side securing hole 431 is positioned so as to oppose the body-side securing portion 311*a* and the cap-side securing portion 311*b* in the connecting direction X. In other words, the body-side securing portion 311*a* and the cap-side securing portion 311*b* are positioned to oppose the device-side securing portion 43 in the fastening direction of the bolt 52. Thus as illustrated in FIG. 5, the tool T for removing the bolt 52 interferes with the body-side securing portion 311*a* and the cap-side securing portion 311*b* when the shield connector 1 is in the coupling state. The device-side securing portion 43 is secured to the unit case U by fastening the bolt 52, thereby securing the device-side connector 4 to the unit case U.

The unit case U is a conductive chassis accommodating an electric device. The whole unit case U is electrically grounded. The unit case U is provided with the opening U1 to which the device-side connector 4 is attached and tapped threads at locations corresponding to the cable-side securing portion 313 and the device-side securing portion 43.

A method of assembling the cable-side connector 3, and a method of coupling the cable-side connector 3 and the device-side connector 4 and securing the coupled cable-side connector 3 and the device-side connector 4 to the unit case U will exemplarily be described.

First, the packing 26, the shield pipe 27, the sealing member 28, and the shield cable 2 to which the female terminal 25 is attached are inserted in the coupling portion 321 of the female housing 32. The device-side connector 4 is inserted in the opening U1 of the unit case U, the male terminal 41 of the electric device is inserted in the insertion portion 42, and the device-side securing portion 43 is secured to the unit case U with the bolt 52. The cable-side connector 3 is coupled to the device-side connector 4 in a manner that the cutout 314 of the shell body 31*a* mates the device-side securing portion 43 and the male housing 40 slides against the inner side of the shield shell 31, so that the male terminal 41 is inserted in the female terminal 25 to be electrically connected thereto. The cable-side securing portion 313 is then secured to the unit case U with the bolt 51 to complete the coupling. In the final phase, with the rib 316 of the shell body 31*a* positioned in the groove 324 of the female housing 32, the female housing 32 and the shield cable 2 are accommodated in the first accommodating portion 3*a* and the second accommodating portion 3*b* of the shell body 31*a*. Then, as indicated in the arrow A in FIG. 3, the shell cap member 31*b* covers the female housing 32 in a manner that the engagement portion 318 of the shell cap member 31*b* is inserted in the recess 325 of the female housing 32. The shell body 31*a* and the shell cap member 31*b* are secured together by securing the body-side securing portion 311*a* and the cap-side securing portion 311*b* with the bolt 31*c*. In this manner, the shield cable 2 and the female housing 32 are held between the shell body 31*a* and the shell cap member 31*b*.

The assembling procedure is not limited to the procedure described above. The order of the steps may suitably be changed as long as the device-side connector 4 is secured to the unit case U via the device-side securing portion 43 before the cable-side connector 3 and the device-side connector 4 are coupled.

Consequently, the shield shell 31 is in contact with the unit case U as well as with the shield pipe 27 by the inner face of the second accommodating portion 3*b* of the shield shell 31. With the shield pipe 27 electrically connected to the shield 23, the unit case U, the shield shell 31, the shield pipe 27, and the shield 23 are in equipotential state, namely, at ground potential. Thus the unit case U, the first accommodating portion 3*a*, the second accommodating portion 3*b*, and the conductor 21 are shielded, preventing electromagnetic waves to leak outside or intruding from outside.

In the procedure of removing the shield connector 1, the device-side connector 4 cannot be removed when the cable-side connector 3 and the device-side connector 4 are coupled because the tool T interferes with the body-side securing portion 311*a* and the cap-side securing portion 311*b* as illustrated in FIGS. 4 and 5. Therefore, the bolt 51 inserted in the cable-side securing portion 313 of the cable-side connector 3 is first removed to decouple the cable-side connector 3 and the device-side connector 4, and then the bolt 52 inserted in the device-side securing portion 43 of the device-side connector 4 is removed.

According to the embodiment described above, the device-side securing portion 43 of the device-side connector 4 is provided in the position to oppose the shell securing portion 311 of the shield shell 31 in the fastening direction (connecting direction X) of the bolt 52 when assembling the connector, so that when the cable-side connector 3 and the device-side connector 4 are coupled, the tool T for removing the bolt 52 interferes with the shell securing portion 311, disallowing the removal of the device-side connector 4, as illustrated in FIG. 5. Thus the device-side connector 4 cannot be removed when the device-side connector 4 is coupled, thereby preventing damage to the electric circuit inside the electric device.

Moreover, the shell securing portion 311 of the shield shell 31 is provided in the position to oppose the device-side securing portion 43 in the connecting direction X and includes the body-side securing portion 311*a* integrally provided on the shell body 31*a* and the cap-side securing portion 311*b* integrally provided on the shell cap member 31*b*, and the body-side securing portion 311*a* and the cap-side securing portion 311*b* are secured together with the bolt 31*c* to secure together the shell body 31*a* and the shell cap member 31*b*. Thus the shell securing portion 311 has the function of securing together the shell body 31*a* and the shell cap member 31*b* and the function of disallowing removal of the device-side connector 4 when the cable-side connector 3 and the device-side connector 4 are coupled. Therefore the structure can be made simple without providing any additional member.

Moreover, since the shell body 31*a* of the cable-side connector 3 includes the cable-side securing portion 313 which is secured to the unit case U with the bolt 51, the cable-side connector 3 is further surely secured to the unit case U, thereby preventing decoupling of the cable-side connector 3 and the device-side connector 4 by, for example, vibration.

Furthermore, since the cable-side securing portion 313 is provided so as not to overlap with the shell securing portion 311 when viewed in the fastening direction of the bolt 51, unfastening of the cable-side securing portion 313 from the unit case U can easily be recognized when removing the cable-side connector 3, which thereby prevents accidental removal of the device-side securing portion 43. That is, since the cable-side securing portion 313 is not overlapping with the shell securing portion 311 in the fastening direction of the bolt 51 but the device-side securing portion 43 is overlapping with the shell securing portion 311 in the fastening direction of the bolt 52, only the bolt 51 securing the cable-side securing portion 313 can be removed. Thus the sequential procedure of removing the shield connector 1 can be determined.

The scope of the present invention is not limited to the embodiment described above. Any other configuration that can achieve the object of the present invention, such as the modifications as will be described below, are included in the scope of the present invention.

For example, in the embodiment described above, the shell securing portion 311 is provided so as to oppose the device-side securing portion 43 in the fastening direction of the bolt 52. Alternatively, it may be configured that the body-side securing portion 311*a* is provided so as to oppose the device-side securing portion 43 in the fastening direction of the bolt 52, so that the tool T for removing the bolt 52 interferes with the body-side securing portion 311*a* even with the shell cap member 31*b* removed. The cable-side securing portion 313 is provided on the shell body 31*a* and the body-side securing portion 311*a* is provided so as to oppose the device-side securing portion 43 in the fastening direction of the bolt 52 for securing the device-side securing portion 43. So that, even when the body-side securing portion 311*a* and the cap-side securing portion 311*b* are unfastened to remove the shell cap member 31*b*, the shell body 31*a* is secured to the unit case U, keeping the cable-side connector 3 and the device-side connector 4 coupled together and disallowing the removal of the device-side securing portion 43 by causing interference between the tool T for removing the bolt 52 and the body-side securing portion 311*a*. In such a configuration, the body-side securing portion 311*a* corresponds to the "opposing portion" in the claims and the cap-side securing portion 311*b* corresponds to the "supporting member securing portion" in the claims.

In the embodiment, the shell securing portion 311 is provided in a position to oppose the device-side securing portion 43 in the fastening direction of the bolt 52 (connecting direction X) to cause interference with the tool T. Alternatively, for example, as long as a member (opposing portion) is provided at the same location to cause interference with the tool T, the shell securing portion 311 may be provided at a position other than the position of the opposing portion.

In the embodiment, the body-side securing portion 311*a* and the cap-side securing portion 311*b* are respectively provided on the main body 310 and the cap main body 320 of the cable-side connector 3 in an integrated manner to serve as the opposing portions. Alternatively, the main body 310 and the cap main body 320 themselves may be configured to serve as the opposing portion. That is, the main body 310 and the cap main body 320 may be formed so as to oppose the device-side securing portion 43 in the fastening direction of the bolt 52 to interfere with the tool T for removing the bolt 52.

Moreover, the device-side connector 4 may be secured to the unit case U with a plurality of device-side securing portions 43. In such a case, the opposing portion may be provided to each of a plurality of device-side securing portions 43. Some or all of a plurality of opposing portions may serve as the shell securing portion 311, or alternatively, the shell securing portion 311 may be provided at a location different from the opposing portion.

In the embodiment, the device-side securing portion 43 is provided to protrude in the Y direction along the unit case U from the side face of the device-side main body 44 in the first side in the Y direction. Alternatively, the device-side securing portion 43 may be provided along a direction other than the Y direction as long as the device-side securing portion 43 is secured onto the unit case U along the unit case U in a manner that the tool T for removing the bolt 52 for securing the device-side securing portion 43 interferes with the shell securing portion 311. When the device-side securing portion 43 is provided along a direction different from the direction described in the embodiment, the shell securing portion 311 is provided in the position corresponding to the device-side securing portion 43.

In the embodiment, the shield cable 2 composed of a coaxial cable is exemplarily described as the cable. Alternatively, the present invention can be applied to a connector using a cable other than the shield cable. In such a case, a member that provides shield for a connector can be omitted, and the shell body 31*a* and the shell cap member 31*b* may be formed of a material with no conductivity, such as a resin.

The best mode and the best method to set forth the present invention is herein disclosed in the above description, but not by way of limitation. That is, the present invention is described and illustrated mainly for particular embodiments. A person skilled in the art can make various changes in shapes, materials, numbers, and any other detailed configuration of the embodiment described above without departing from the scope of the technical idea and the object of the present invention.

The specific shapes and materials, for example, are described by way of illustration, not by way of limitation, to ease understanding of the present invention. A component referred to as a term without some or all of the words representing specified shapes and materials are all included in the scope of the present invention.

REFERENCE SIGNS LIST

1 shield connector (connector)
2 shield cable (cable)
3 cable-side connector
4 device-side connector (object-side connector)
31 shield shell (supporting member)
32 female housing (housing)
43 device-side securing portion (object-side securing portion)
51 bolt (other fastening member)
52 bolt (fastening member)
31*a* shell body (first supporting member)
31*b* shell cap member (second supporting member)
311 shell securing portion (opposing portion)
311*a* body-side securing portion (first opposing portion)
311*b* cap-side securing portion (second opposing portion)
313 cable-side securing portion

The invention claimed is:

1. A connector comprising:

a cable-side connector for supporting a cable and a terminal part secured to a distal end of the cable; and an object-side connector provided on a connecting object and coupled to the cable-side connector, wherein the object-side connector includes an object-side securing portion secured to the connecting object, and the object-side securing portion is secured to the connecting object with a first detachable fastening member and protrudes in a connecting direction from the object-side connector to be spaced from the cable side connector, wherein the cable-side connector includes a housing supporting the cable and the terminal part, a supporting member supporting the cable and the housing, an opposing portion protruding from the supporting member in a width direction along a height direction in a location opposing the object-side securing portion in a fastening direction of the the first detachable fastening member and configured for receiving a securing member, and a cable-side securing portion secured to the connecting object with a second detachable fastening member in a direction parallel with the first detachable fastening member, wherein the cable extends in the connecting direction of the cable-side connector and the object-side connector, and is supported by the cable-side connector, wherein the cable-side securing portion is provided such as to avoid overlapping with the opposing portion when viewed in the fastening direction of the second detachable fastening member, wherein the object-side connector is housed in the supporting member, and wherein the supporting member includes a cutout for housing the object-side connector with the object-side securing portion protruding from the supporting member, the cutout having a shape tracing a profile of the object-side securing portion.

2. The connector according to claim 1, wherein the supporting member includes a first supporting member and a second supporting member and supports the cable and the housing between the first supporting member and the second supporting member, the opposing portion includes a first opposing portion integrally provided on the first supporting member, and a second opposing portion integrally provided on the second supporting member, and securing member securing together the first opposing portion and the second opposing portion by securing together the first supporting member and the second supporting member.

3. The connector according to claim 2, wherein the supporting member includes a first supporting member and a second supporting member and supports the cable and the housing between the first supporting member and the second supporting member, the opposing portion is integrally provided on the first supporting member, and the cable-side securing portion is integrally provided on the first supporting member.

4. The connector according to claim 3, wherein the cable-side connector includes a supporting member securing portion integrally provided on the second supporting member, and the first supporting member and the second supporting member are secured together by the securing member securing together the opposing portion and the supporting member securing portion.

* * * * *